US009267297B2

(12) United States Patent
Zinssler

(10) Patent No.: US 9,267,297 B2
(45) Date of Patent: Feb. 23, 2016

(54) METHOD FOR PRODUCING A DRYWALL

(71) Applicant: Sven Zinssler, Sennfeld (DE)

(72) Inventor: Sven Zinssler, Sennfeld (DE)

(73) Assignee: KNAUF GIPS KG, Iphofen (DE)

( * ) Notice: Subject to any disclaimer, the term of this patent is extended or adjusted under 35 U.S.C. 154(b) by 0 days.

(21) Appl. No.: 14/397,632

(22) PCT Filed: May 2, 2013

(86) PCT No.: PCT/EP2013/059121
§ 371 (c)(1),
(2) Date: Nov. 14, 2014

(87) PCT Pub. No.: WO2013/164393
PCT Pub. Date: Nov. 7, 2013

(65) Prior Publication Data

US 2015/0113895 A1 Apr. 30, 2015

(30) Foreign Application Priority Data

May 2, 2012 (DE) ..... 10 2012 103 836

(51) Int. Cl.

| | |
|---|---|
| ***E04C 1/00*** | (2006.01) |
| ***E04F 21/00*** | (2006.01) |
| ***E04F 13/08*** | (2006.01) |
| ***E04F 13/14*** | (2006.01) |
| ***E04B 2/74*** | (2006.01) |
| ***E04F 21/02*** | (2006.01) |
| ***E04F 21/08*** | (2006.01) |

(52) U.S. Cl.
CPC ..... *E04F 21/0092* (2013.01); *E04B 2/7457* (2013.01); *E04F 13/0803* (2013.01); *E04F 13/0885* (2013.01); *E04F 13/14* (2013.01); *E04F 21/02* (2013.01); *E04F 21/023* (2013.01); *E04F 21/026* (2013.01); *E04F 21/08* (2013.01); *E04B 2002/7472* (2013.01); *Y10T 29/49629* (2015.01)

(58) Field of Classification Search
CPC ..... E04F 21/0092; E04F 21/22; E04F 21/00; E04F 15/02005; E04F 21/18; E04F 21/185; E04F 13/0841; E04G 21/1891; F16M 13/027; F16B 5/0004
See application file for complete search history.

(56) References Cited

U.S. PATENT DOCUMENTS

| | | | | | |
|---|---|---|---|---|---|
| 1,727,420 | A | * | 9/1929 | Walper | 52/363 |
| 2,258,574 | A | * | 10/1941 | Leary | 52/362 |
| 3,113,358 | A | * | 12/1963 | Zell et al. | 312/263 |
| 4,018,020 | A | | 4/1977 | Sauer | |
| 4,056,904 | A | | 11/1977 | Dawdy | |

(Continued)

FOREIGN PATENT DOCUMENTS

| | | | |
|---|---|---|---|
| DE | 202011103156 U | | 4/2012 |
| WO | WO2011012994 | * | 3/2011 |

*Primary Examiner* — Brian Glessner
*Assistant Examiner* — Gisele Ford
(74) *Attorney, Agent, or Firm* — Andrew Wilford

(57) ABSTRACT

The invention relates to a method for producing a drywall. In the method, a panel made of a plurality of paneling boards (3) placed alongside one another is fixed to a frame structure (1). According to the invention, fixation elements (5) are first affixed to a substructure (2) in the edge area of a paneling board (3) and/or in the joint area (4) of two adjacent paneling boards (3). Then, by means of a clamping tool (7) for example, fastening elements (6) are set alongside the fixation elements (5), the respective paneling board (3) being simultaneously clamped between the substructure (2) and the fastening element (6).

12 Claims, 5 Drawing Sheets

(56) References Cited

U.S. PATENT DOCUMENTS

| | | | | | |
|---|---|---|---|---|---|
| 4,302,989 | A | * | 12/1981 | Tolksdorf | 81/421 |
| 4,397,125 | A | * | 8/1983 | Gussler, Jr. | 52/127.3 |
| 4,448,007 | A | * | 5/1984 | Adams | 52/489.2 |
| 4,449,338 | A | * | 5/1984 | Reicherts | 52/127.8 |
| 4,485,543 | A | * | 12/1984 | Flores et al. | 29/281.1 |
| 4,782,642 | A | * | 11/1988 | Conville | 52/770 |
| 4,867,403 | A | * | 9/1989 | Anderson | 248/216.1 |
| 4,889,459 | A | * | 12/1989 | Anderson | 411/400 |
| 5,079,888 | A | * | 1/1992 | Hileman et al. | 52/514 |
| 5,152,117 | A | * | 10/1992 | Wynar | 52/712 |
| 5,224,309 | A | * | 7/1993 | Bodell | 52/127.1 |
| 5,249,405 | A | * | 10/1993 | Miller | 52/712 |
| 5,366,329 | A | * | 11/1994 | Burgess | 411/368 |
| 5,371,994 | A | * | 12/1994 | Waters | 52/749.1 |
| 5,407,183 | A | * | 4/1995 | Singeltary | 269/43 |
| 5,655,337 | A | * | 8/1997 | Bryant et al. | 52/127.2 |
| 5,675,942 | A | * | 10/1997 | Crawford | 52/127.3 |
| 5,921,058 | A | * | 7/1999 | Brooker | 52/749.1 |
| 5,966,893 | A | * | 10/1999 | Quillin | 52/713 |
| 6,131,361 | A | * | 10/2000 | Murphy | 52/712 |
| 6,364,303 | B1 | * | 4/2002 | Gustavson | 269/37 |
| 6,662,522 | B2 | * | 12/2003 | Nichols et al. | 52/747.1 |
| 6,904,732 | B1 | * | 6/2005 | Richmond | 52/749.1 |
| 7,421,829 | B2 | * | 9/2008 | Gwynn | 52/749.13 |
| 7,584,586 | B2 | * | 9/2009 | Decker | 52/747.1 |
| 7,694,464 | B2 | * | 4/2010 | Garcia et al. | 52/94 |
| 7,954,300 | B1 | * | 6/2011 | Kufner et al. | 52/749.11 |
| 7,995,605 | B2 | * | 8/2011 | Thousand et al. | 370/450 |
| 8,079,199 | B1 | * | 12/2011 | Kufner et al. | 52/749.11 |
| 8,555,594 | B2 | | 10/2013 | Grandi | |
| 8,661,639 | B2 | | 3/2014 | Bondielli | |
| 2005/0166484 | A1 | * | 8/2005 | Richmond | 52/127.12 |
| 2006/0185278 | A1 | * | 8/2006 | Jaffe | 52/271 |
| 2007/0033791 | A1 | * | 2/2007 | Gerrety et al. | 29/426.5 |
| 2008/0040988 | A1 | * | 2/2008 | Holt | 52/127.2 |
| 2008/0176469 | A1 | * | 7/2008 | Dong et al. | 442/58 |
| 2008/0236094 | A1 | * | 10/2008 | Doda | 52/749.11 |
| 2013/0199124 | A1 | * | 8/2013 | Roberts | 52/749.1 |

* cited by examiner

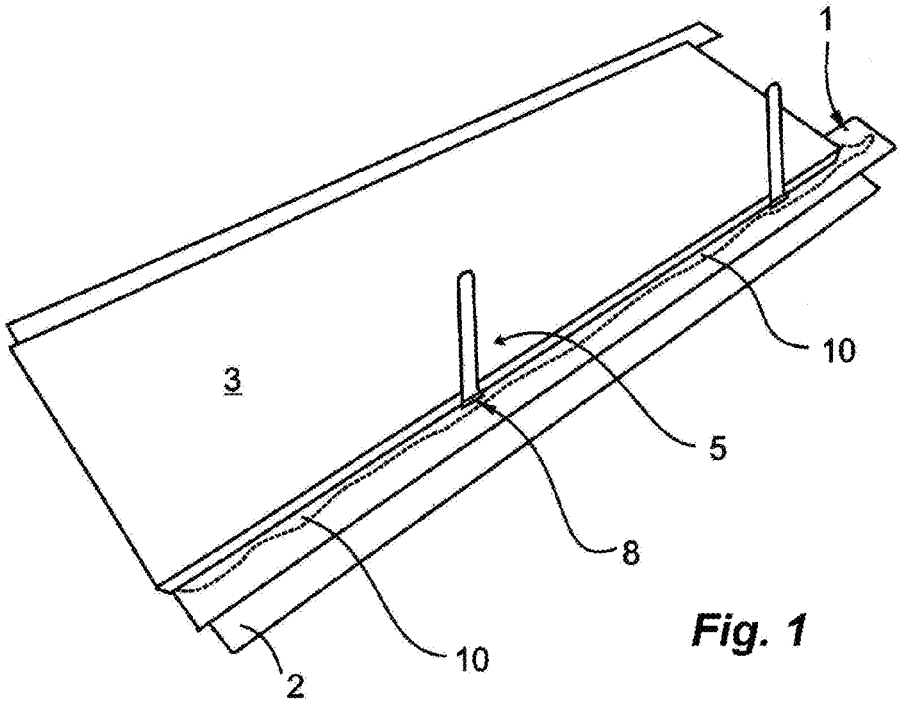
Fig. 1
Fig. 2
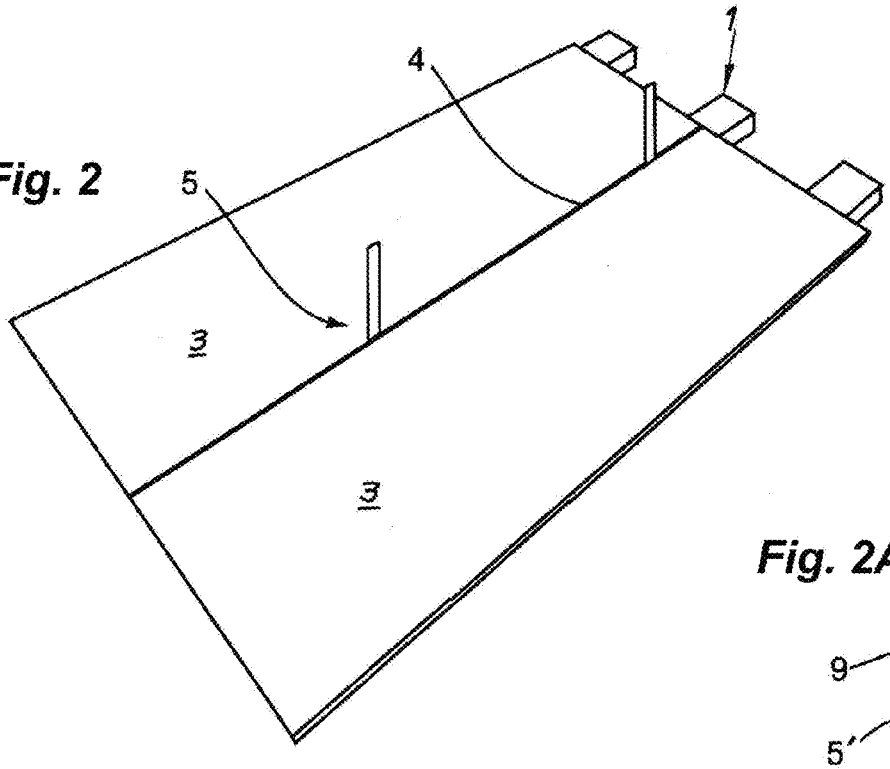
Fig. 2A
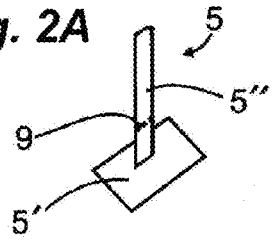

METHOD FOR PRODUCING A DRYWALL

CROSS REFERENCE TO RELATED APPLICATIONS

This application is the US-national stage of PCT application PCT/EP2013/059121 filed 2 May 2013 and claiming the priority of German patent application 102012103836.8 itself filed 2 May 2012.

FIELD OF THE INVENTION

The invention relates to a method of making a drywall, according to which a cladding made of a plurality of wallboards placed alongside one another is fixed on a frame.

According to the conventional understanding, drywall construction does not use water-containing construction materials such as concrete or plaster. In fact, not only can a room partition be made using such drywall, but also ceiling panels or false ceilings—and also wall panels—may also be made. Dry subfloors or cavity floors can also be produced using such drywall. For this purpose, the frame is usually done first, typically from a plurality of profile beams. The profile beams are mostly designed as hollow metal profiles so that the frame is typically a hollow metal-profile stud frame.

The boards are then attached as cladding to the frame after its erection. This can be performed on the room side in the meaning of the above-described cladding or also on both sides of the frame that is accommodated centrally in the interior. Drywalls are thus used for room partitioning.

The wallboards are typically insulation slabs that are in turn implemented as plaster boards, gypsum-fiber boards, wooden composite boards, etc. In general, quarry tiles, cement slabs, etc. can also be used as wallboard. Moreover, additional coverings, for example, wallpaper, dry plaster, paints, or also floor coverings, such as those made of linoleum, parquet, carpets, etc. may be applied as a finish.

Because of the described design, drywall is distinguished by great flexibility and cost-effective production. This is also known in the prior art according to WO 2009/153674 [U.S. Pat. No. 8,555,594]. The fixing of the individual wallboards on the frame is carried out in different ways. Thus, screw fastening is known from practice, as is fastening using adhesives.

Screw fastening has the disadvantage that the wallboard is damaged by the screw and possibly must be finished. In the case of adhesive fastening, the individual wallboards must be temporarily held to the frame until the adhesive is cured. The effort entailed by the two described fastening methods is enormous.

In the prior art according to DE 20 2011 103 156, the production of expansion joints and butt joints of construction boards in wall systems is described. A joint profile consisting of two materials connected to one another is used for this purpose. It can be composed of a groove profile and a cover profile for covering the groove profile. In addition, an adhesive surface is provided for gluing the groove profile onto a substructure. The known joint profiles are obviously not capable of fixing and mounting individual wallboards.

OBJECT OF THE INVENTION

The object of the invention is to provide such a method of making a drywall that the most damage-free possible attachment of the wallboards on the frame is achieved, specifically in a simple manner and also rapidly and cost-effectively.

SUMMARY OF THE INVENTION

To attain this object, a method according to the field of drywall construction is characterized in the scope of the invention in that fixation elements are first fixed to a substructure at the edge of a wallboard and/or in the joint between two adjacent wallboards, and then a tightening tool, for example, fixed the holddown clips to the fixation elements, the wallboard being simultaneously clamped between the substructure and the holddown clip.

The one more wallboards can be fastened on the frame solely by the compound action of the fixation elements, on the one hand, and the holddown clips fixed thereon, on the other hand. The wallboard is then permanently clamped between the substructure and the holddown clip in question. However, temporary fixing or clamping is also similarly possible.

This is because the above-described fastening method is generally used more or less as "pre-fixing" or temporary fixing or clamping, and this is done during the time within which an adhesive cures that was previously applied to the rear of the wallboard to be fixed. As soon as the adhesive has the required load-bearing capacity to be able to fix the wallboard on the frame profile or the frame alone, the individual fixation elements or holddown clips can be removed.

Practically damage-free fixing of the wallboards on the frame is thus provided. This is because the "pre-fixing" is carried out by the compound action of the fixation elements, on the one hand, and the holddown clips, on the other hand that can be removed as a whole after the pre-fixing. The actual "main fixing", in contrast, is generally assumed by the adhesive that is cured after the pre-fixing. Basically, the wallboard can also be fixed on the frame without using additional adhesive, solely by the compound action of the fixation elements, on the one hand, and the associated holddown clips, on the other hand.

In the scope of a preferred variant, the fixation element is fixed on a profile beam of the frame as the substructure. This means that the profile beam of the frame functions as the substructure for fixing the fixation element. In principle, however, the invention can also work with other substructures, for example, in the form of a separate substructure that is held by the frame. For reasons of the simplest and most cost-effective possible manufacturing, however, this will typically be omitted, so that the individual profile beams of the frame function as the substructure for fixing the individual fixation elements. This means the profile beams as the stud framework for the drywall to be produced represent, as the substructure, the primarily used attachment location of the fixation elements. In this case, the profile beams can consist of any desired materials, for example, of wood, plastic, etc. However, metal hollow profiles are generally used as the profile beams, in particular those made of steel.

The fixation element is advantageously a fastening strap that also projects beyond the wallboard on the front side. This means that the fastening strap projects with its strap end beyond an outer face of the wallboard and clearly projects more or less beyond the surface. In this manner, the fastening strap as a whole or its strap end can be used more or less as a tie rod for attaching the associated holddown clip.

It is possible that the fixation element engages with a foot in a seat and in particular a slot in the substructure. However, the fixation element or the fastening strap generally engages through a seat and in particular a slot in the substructure. In addition, the fixation element or the fastening strap alternatively or also engages through a further seat and in particular a slot in the holddown clip. The fixation element or the fastening strap is usually composed of a foot and a strap end or the actual strap attached thereon. The strap or the strap end engages through the seat and in particular the slot in the substructure and/or in the holddown clip. In this case, the fixation element or the fastening strap can be inserted into the seat and in particular the slot until the foot presses against the substructure on its rear side. On the outer face, the strap end engages through the seat and in particular the slot and projects predominantly perpendicularly.

Insofar as the substructure is a profile beam, the profile beam in question is equipped with the seat or slot for the fixation element. Such a seat or slot may be readily made in the profile beam, because such profile beams are typically embodied as metallic hollow profiles. The seat and in particular the slot may thus be integrated in typical metal stamping and bending operations, with the aid of which such metallic hollow profiles are produced. This means that the seat or slot can be implemented in the profile beam without problems.

The fixation element generally has at least one intended breakpoint. This intended breakpoint is used so that the fixation element having the holddown clip fixed thereon is removed or can be removed, usually after curing of the adhesive between the substructure and the wallboard. This may generally be carried out in that the fixation element or its strap end having the holddown clip fixed thereon in each case can simply be knocked off after the curing of the adhesive or subjected to other shearing impact. This operation is favored by the intended breakpoint. This also applies for the case in which, with the aid of the tightening tool, the fixation element is severed at the intended breakpoint by a corresponding force or clamping force. This means that in this case an operator ensures, with the aid of the tightening tool, that the strap end of the fixation element is severed from its foot at the intended breakpoint. For this purpose, it is only necessary for an operator to apply the appropriate force using the tightening tool.

In this case, the design is usually made so that the intended breakpoint, in the installed state of the fixation element, is arranged at most at the level with the outer face of the wallboard. The intended breakpoint is generally located at the lower foot end of the strap or the strap end in the transition to the foot. The invention thus ensures that when the strap end is removed, a stump of the fixation element, which is still fixed on the substructure or the profile beam, cannot project beyond the wallboard or its outer face. The edge or joint of the wallboard processed in this manner may thus be filled without difficulty, specifically while simultaneously covering the stump of the fixation element that is broken off at the intended breakpoint.

Generally, however, the stump and therefore the intended breakpoint at the edge or joint are no (longer) visible at all after ending the fastening operation. This is because the strap or the strap end is sheared off at the foot, so that the foot pressing against the rear side thereof on the substructure or the interior of the profile beam can drop down in the profile beam. The strap or the strap end together with the holddown clip fixed thereon is simultaneously removed on the outer face of the wallboard or the adjacent wallboards. The "pre-fixation" is thus eliminated and the wallboard is exclusively held by adhesive on the substructure or the profile beam. This has the advantage that the fixation element that is typically produced from plastic, and also the holddown clip made of plastic are removed from the attachment location and therefore no combustible materials are present in this area. This increases fire resistance.

The tightening tool for fixing the holddown clip on the fixation element is generally designed so that this tool fixes the holddown clip on the fixation element in a defined clamped position. For this purpose, the fixation elements and the holddown clip are advantageously equipped with complementary catch formations. These catch formations can be interlocking teeth. Alternatively or also, other catch formations are also conceivable, for example, a cutting edge that engages in the strap or the strap end made of plastic, made of metal or other locking means that ensure the fixing of the holddown clip on the fixation element in the desired clamping position.

In addition, the design is usually made so that the tightening tool holds the holddown clip and/or engages in a recess on the holddown clip. In the scope of the first variant, the tightening tool can be equipped, for example, with a seat, an indentation, or the like, with the aid of which the holddown clip is detachably fixed on the tightening tool. This means that the tightening tool carries the holddown clip up to its unification with the fixation element. Alternatively or also, however, the tightening tool can also engage in a recess in the holddown clip. Both basic procedures basically ensure that the tightening tool and the holddown clip are aligned relative to one another, to make the uniting easier.

To unite the fixation element or fastening strap and holddown clip, the holddown clip having the slot or the slot is fitted over the fastening strap. The catch formations or locking means that correspond to one another allow movement of the holddown clip with the aid of the tightening tool along the fastening strap toward the wallboard and finally fixedly clamp it. As a result of the catch formations, a opposite movement of the holddown clip is no longer possible.

During fixing of the holddown clip on the fixation element, the normally manually operable tightening tool thus ensures that the holddown clip is pushed over the strap end of the fixation element formed as the fastening strap and catches thereon. The tightening tool uses the fixation element in this context as a tie that is also fixed on the substructure or the profile beam, so that with its aid, the wallboard can be pressed against the substructure or the profile rail.

The tightening tool is generally detachably coupled to the fixation element so the tightening tool can be used again and again. In addition, the tightening tool fixes the holddown clip in the defined clamping position on the fixation element by an integrated tightening mechanism. The integrated tightening mechanism may be operated without difficulty by an operator, so that the tightening tool can carry out its clamping action.

Alternatively or also, a operating tool attachable to the tightening tool can also be provided. With the aid of the operating tool attached to the tightening tool, the holddown clip may again be fixed in the defined and desired clamping position on the fixation element. The operating tool is advantageously a conventional hand tool, for example, an open-end wrench, an Allen wrench (hex wrench), a screwdriver, a battery-powered screwdriver, etc. Such operating tools are available cost-effectively and practically as desired in large numbers, so that in this case a specially designed tightening tool is not necessary or is only used to a restricted extent.

In addition, it has proven itself if the tightening tool is secured against excessively high clamping forces with the aid of at least one stop. This at least one stop ensures that the tightening tool fixes the holddown clip in the defined or desired clamping position on the fixation element and clamps the at least one wallboard to the substructure. The defined or desired clamping position corresponds to the clamping forces applied at this point by the tightening tool not being designed to be excessively high, for example, not resulting in separation of the intended breakpoint on the fixation element or the fixation element or its strap end being torn off by the tightening tool during the actual clamping operation.

The tightening tool may usually be aligned in various clamping positions relative to the holddown clip and therefore of the at least one wallboard relative to the substructure. In fact, an installation position, a gluing position, and also a detachment position or tear-off position are conceivable and are comprised by the invention. In the installation position, the tightening tool is fixed and possibly aligned on the fixation element. The gluing position corresponds to the desired and defined clamping position that provides the required clamping forces during the curing of the adhesive bond. The detachment or tear-off position is finally associated with the fixation element—optionally—separating at the intended breakpoint with the aid of the tightening tool. Of course, this is not compulsory and is only to be considered to be a conceivable possibility.

As soon as the wallboard is clamped between the holddown clip and the substructure or the associated profile beam of the frame, the tightening tool releases the holddown clip. Due to the compound action of the complementary catch formations or locking means on the fixation element, on the one hand, and the holddown clip, on the other hand, the holddown clip is fixedly connected to the fixation element and can no (longer) be detached therefrom, unless the fixation element is subjected to a shearing impact such that the fixation element breaks at the intended breakpoint. In this manner, the holddown clip can be reused and inserted again without problems for subsequent fastening. In contrast, the fixation element is generally lost, because the foot and the strap or the strap end are disconnected from one another. However, this does not represent a severe disadvantage in this case, because the fixation element is available as a cost-effective plastic injection-molded part.

The object of the invention is also drywall that has been produced according to the above-described method. In this case, the wallboards experience additional temporary fixation at least during a curing phase of the adhesive, specifically using a plurality of fixation elements fastened on the substructure. In addition, the temporary fixation of holddown clips that are fixed with the aid of the tightening tool on the fixation elements is achieved with simultaneous clamping of the wallboard.

BRIEF DESCRIPTION OF THE DRAWING

The invention will be explained in greater detail hereafter with reference to a drawing that only illustrates an illustrated embodiment, in the figures:

FIG. 1 shows a first step of making the drywall of this invention according to a first embodiment variant;

FIG. 2 shows a second step of the method;

FIG. 2A shows a detail of an element of the invention used in the second step;

SPECIFIC DESCRIPTION OF THE INVENTION

Figure 4:
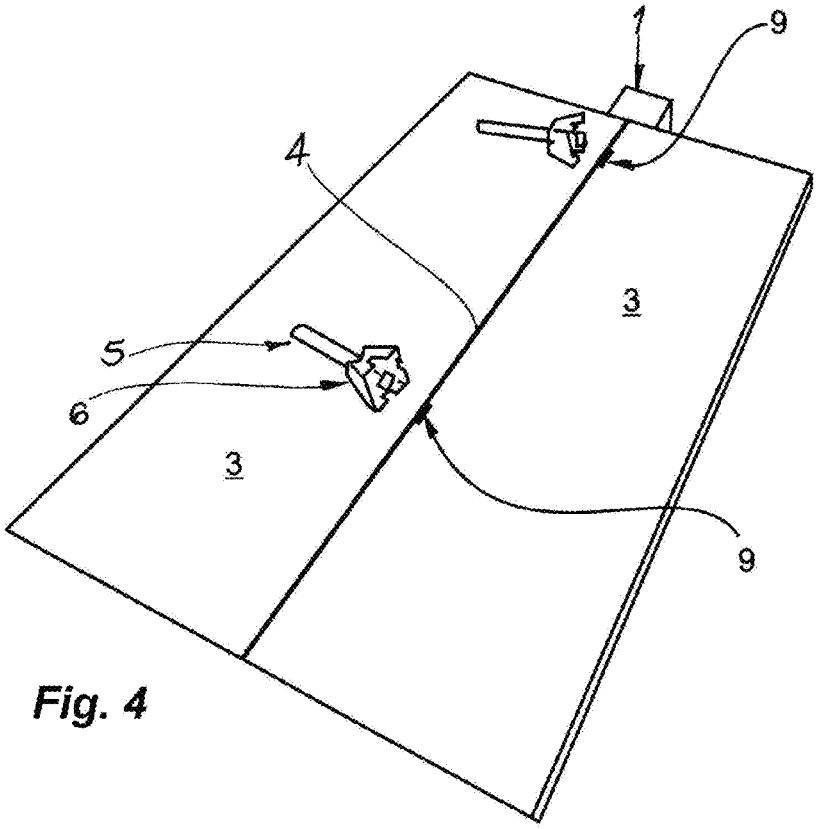
FIG. 4 shows a fourth step of the method.
Figure 5:
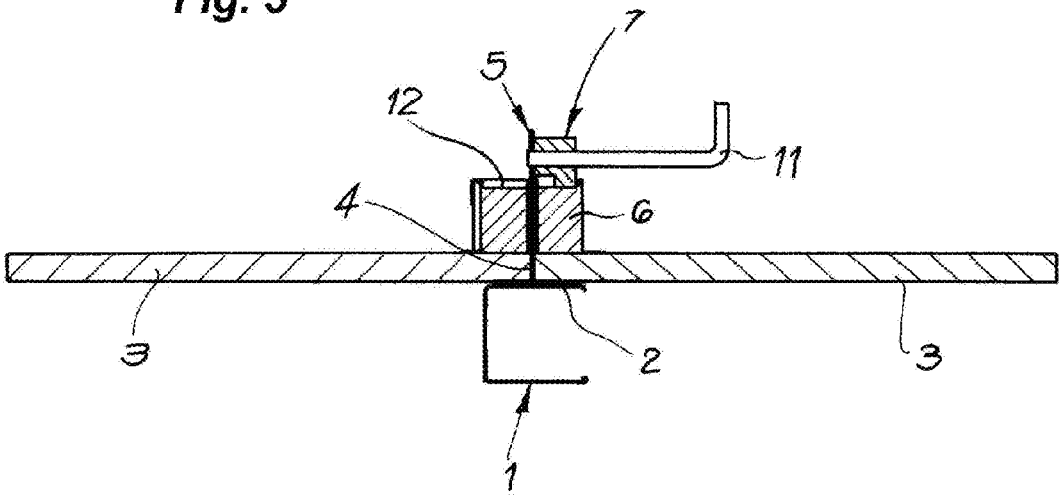
FIG. 5 is a section through second variant of the invention of making the drywall.
Figure 6:
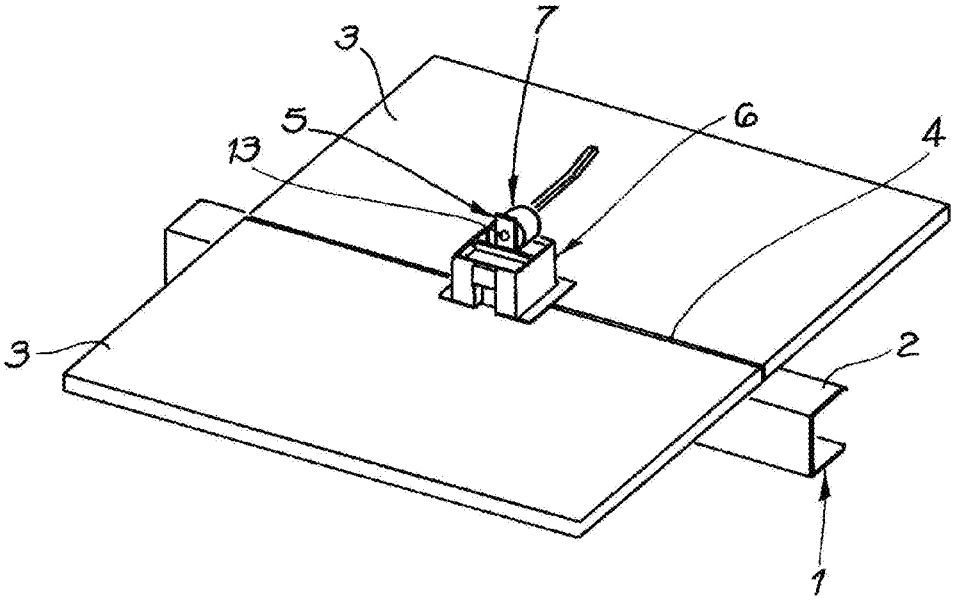
FIG. 6 is a perspective view of the second variant.
Figure 7A:
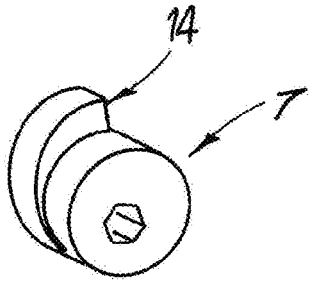
FIGS. 7A, 7B, and 7C are vies of elements of the second variant.
Figure 7B:
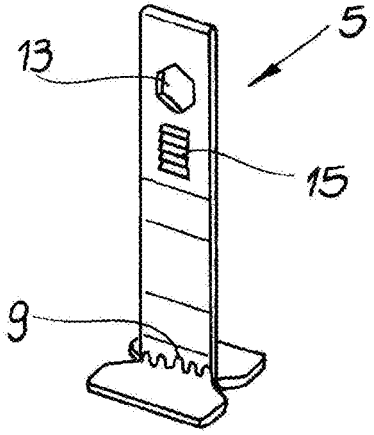
Figure 7C:
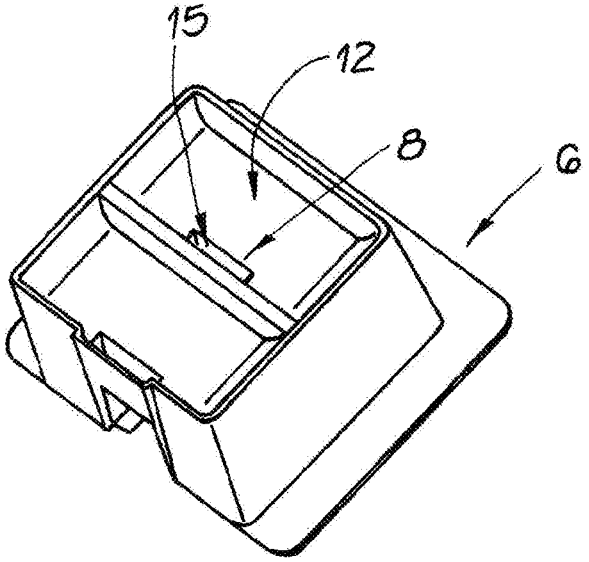

The figures show a schematic detail of a drywall that has a frame 1. The frame 1 is composed in the example of a plurality of profile beams 2 that are optionally connected to one another like timber framing and that may be in the illustrated embodiment (not restrictively) so-called C-profile beams. Generally speaking, the profile beams 2 are metal hollow profile studs. Cladding made of a plurality of wallboards 3 placed alongside one another is fixed on the frame 1. It can be seen that the wallboards 3, as shown in FIGS. 2 and 5, define a joint or a joint area 4 between them. This joint 4 can be formed as a shadow gap or may be filled after the last production step according to the illustration in FIG. 4 or FIG. 8, respectively.

To produce the illustrated drywall, first and following an entire or partial erection of the frame 1, one or more fixation elements 5 are fastened to a substructure 2 at the edge of the wallboard 3 or, according to the illustrated embodiment corresponding to FIGS. 1 and 2 or 5 and 6, at the joint 4 or in the joint 4 between two adjacent wallboards 3. In fact, a plurality of fixation elements 5 is used that are fastening straps 5 in the illustrated embodiment. The substructure 2 is formed in the example by the profile rail 2.

Figure 3:
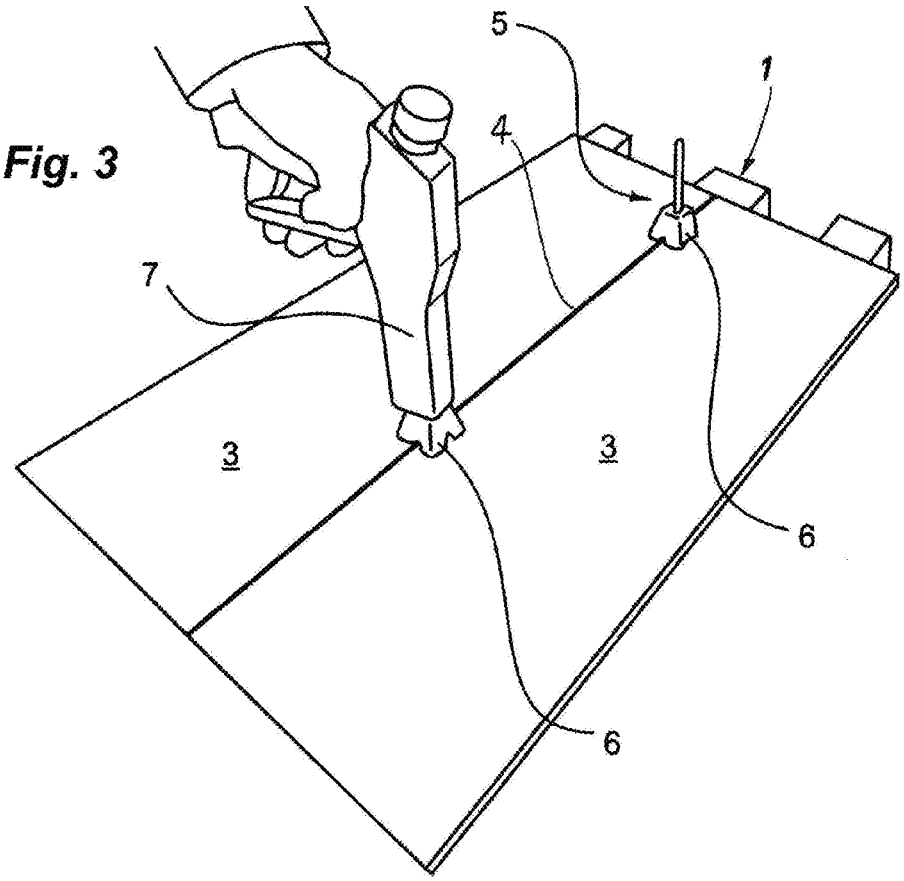
FIG. 3 shows a third step of the method.

The fixation element or the fastening strap 5 interacts with a holddown clip 6. The holddown clip 6 is fixed with the aid of a tightening tool 7, as shown in the illustration in FIG. 3, on the fixation element or the fastening strap 5. Of course, other fastening methods are also conceivable, for example, one without using the tightening tool 7. In any case, the fixation element or the fastening strap 5 projects beyond the outer face of the wallboard 3, so that in the illustrated embodiment the inserted tightening tool 7 together with the holddown clip 6 held thereon can build up the required clamping force. As a result, the wallboard 3 is clamped between the holddown clip 6 and the substructure or the profile beam 2. In this context, the fixation element or the fastening strap 5 also functions as a fastening holddown clip that is fixed on the substructure or the profile beam 2.

The fixation element or the fastening strap 5 is fastened with a foot 5' in a slot 8 in the substructure 2. In addition, the fixation element or the fastening strap 5 engages through a further slot 8 in the holddown clip 6. In fact, the fixation element or the fastening strap 5 engages with one strap end 5" through the slot(s) 8, specifically until the foot 5' presses at the rear side against the substructure 2. In addition, the fixation element 5 has an intended breakpoint 9 that can be seen in particular in the illustration according to FIG. 4. The intended breakpoint 9 is at most at the level of an outer face of the wallboard 3 in the installed state of the fixation element 5. In FIG. 4, the intended breakpoint 9 is only shown for the sake of clarity. In fact, the intended breakpoint 9 usually cannot be recognized at the end of the production of the drywall corresponding to FIG. 4, however, because the strap end 5" is disconnected from the foot 5' and both components are removed, as described above.

As already explained, the tightening tool 7 holds the holddown clip 6 and fixes it on the fixation element 5 in a defined clamping position. For this purpose, the slot 8 of the holddown clip 6 is fitted over the fixation element or the fastening strap 5. In this clamping position, the tightening tool 7 is removed from the fixation element 5 and also the holddown clip 6, as can be seen in the transition from FIG. 3 to FIG. 4. This is possible because the fixation element 5 and the holddown clip 6 are equipped with complementary catch formations 15. The holddown clip 6 pushed onto the fixation element 5 is thus fixed thereon and simultaneously presses the wallboard 3 against the substructure or the profile beam 2. The wallboard 3 is thus fixed on the substructure or profile beam 2.

The method steps are as follows. First, the frame 1 is entirely or partially built and produced from one or the plurality of profile beams 2. Subsequently thereto, the one or the plurality of wallboards 3 are—temporarily—fixed on the frame 1. For this purpose, the substructure or the profile beam 2 is coated with an adhesive 10 that can be seen in FIG. 1 and that cures within a predefined curing time and finally ensures that the wallboard 3 is permanently fixed to the frame 1. The adhesive 10 is a silane-based curing adhesive. A silane-terminated polyether adhesive can actually be used.

In order that, during this curing time of the adhesive 10, the wallboard 3 does not fall off of the frame 1, the fixation elements 5 are fixed on the profile beam or the substructure 2. For this purpose, the fixation element or the fastening strap 5 engages with its strap end 5" through the slot 8 in the substructure or the profile beam 2. At the end of this operation, the foot 5' presses against the rear side of the substructure 2. Subsequently thereto, the tightening tool 7 equipped with the holddown clip 6 is put onto the fixation element or the fastening strap 5 (see FIG. 3).

The tightening tool 7 uses the fixation element or the fastening strap 5 as a tie and is capable in this manner of pressing the wallboard 3 against the substructure or the profile rail 2. In the illustrated embodiment according to FIGS. 1 to 4, the holddown clip 6 overlaps the joint 4 between the two adjacent wallboards 3 for this purpose, so that in this manner both wallboards 3 are temporarily fixed on the middle profile rail 2 relative thereto as the substructure 2 in one stroke.

The wallboards 3 thus experience, at least during the curing phase of the adhesive 10, the described additional temporary fixation by the interaction between the fixation element or the fastening strap 5 and the holddown clip 6. This is because the tightening tool 7 ensures that the holddown clip 6 is fixed on the fixation element 5 or on the fastening strap 5 by the interlocking catch formations 15. Simultaneously, the wallboard 3 is clamped in this case between the holddown clip 6 and the substructure or the profile rail 2.

As soon as the curing time of the adhesive 10 has passed, the fixation element or the fastening strap 5 can be removed together with the holddown clip 6. For this purpose, the fixation element 5 may be struck a shearing blow or impacted and is separated at the intended breakpoint 9. Alternatively thereto, however, the tension on the fixation element 5 can also be increased using the tightening tool 7 until the fixation element 5 breaks at the intended breakpoint 9. In any case, the strap end 5" is sheared off together with the holddown clip 6 from the foot 5'. The foot 5' usually then falls inside the profile rail 2 to the ground.

Finally, the joint 4 between the adjacent wallboards 3 can then also be filled with sealant. In this case, a stump or foot 5' of the fixation element 5 may simultaneously be covered, if the foot 5' has previously been (adhesively) fixed on the profile rail 2. Generally, however, it is not necessary to cover the stump or foot 5' because the foot falls to the ground inside the profile rail 2 after the described operation.

Basically, it is also possible to work without adhesive 10. In this case, the compound action of the fixation element 5, on the one hand, and the holddown clip 6, on the other hand, ensures a permanent fixation of the wallboard 3 on the substructure or the associated profile beams 2. This may work such that, for example, the holddown clip 6 remains on the outer face of one or both adjacent wallboards 3. Generally, however, a procedure is used so that in addition to a first holddown clip 6, a second holddown clip (not shown) is employed. The second holddown clip may fix the two adjacent wallboards 3 relative to one another and connect them to the fixation element 5, for example. For this purpose, the second holddown clip can be equipped with a slot in a plate-like manner and can be fitted like the first holddown clip 6 over the fixation element or the fastening strap 5 for fixing.

The second plate-like holddown clip can engage on both sides in grooves of the wallboards 3. The intended breakpoint 9 may now be located above this second holddown clip. The first holddown clip 6 is made like the holddown clip 6 shown in the drawings.

For installation, both adjacent wallboards 3 are fitted with their grooves onto the plate-like second holddown clip that is in turn fitted with its slot onto the strap end 5" of the fastening strap 5. With the aid of the first holddown clip 6, the two adjacent wallboards 3 can now again be fixed between the first holddown clip 6 and the substructure 2. To finish, the first holddown clip 6 may be sheared off. Since the intended breakpoint 9 is located outward of the second holddown clip, the second holddown clip remains fixed on the strap end 5" of the fastening strap 5. This is also true for the two adjacent wallboards 3 that are permanently fixed with the aid of the second holddown clip on the substructure 2.

A comparable procedure is used in the second embodiment according to FIGS. 5 to 8, where identical components are each provided with identical reference numerals. In contrast to the first variant shown, the tightening tool 7 is designed in the second variant according to FIGS. 5 to 8 as an eccentric clamp. In contrast, the tightening tool 7 according to the variant in FIGS. 1 to 4 is more like a chuck. In each case, the tightening tool 7 ensures that the holddown clip 6 is fixed on the fixation element 5 in a defined clamping position. Achieving the defined clamping position simultaneously corresponds to one or more wallboards 3 being fixed on the frame 1 or the profile beam 2 of the frame 1.

For this purpose, the tightening tool 7 according to the variant in FIGS. 1 to 4 or the chuck provided at this point has an integrated tightening mechanism. This tightening mechanism is triggered and operated in that an operator, corresponding to the illustration according to FIG. 3, operates the tightening tool 7 or an associated handle using his hand and in this manner, with the aid of the tightening tool 7 or the collet chuck implemented at this point, builds up the required clamping forces between the holddown clip 6 and the fixation element 5.

In the alternative procedure according to FIGS. 5 to 8, the tightening tool 7 or the eccentric clamp therein can be equipped with an attachable operating tool 11. This operating tool 11 is a simple Allen wrench in the illustrated embodiment. Basically, the tightening tool 7 or the eccentric clamp according to the illustrated embodiment in FIGS. 5 to 8 can also be actuated by a screwdriver, an open-end wrench, a ratchet, a screwdriver, or a similar generally typical and available operating tool. It is thus possible to apply the required clamping force without a complex tightening tool 7, the already described eccentric clamp being sufficient at this point.

In addition, it can be seen that in the variant according to FIGS. 1 to 4, the tightening tool 7 holds the holddown clip 6. In contrast, in the illustrated embodiment according to FIGS. 5 to 8, the tightening tool 7 engages in a recess 12 on the holddown clip 6. Moreover, the tightening tool 7 is detachably coupled to the fixation element 5 in both illustrated embodiments. This can be performed in the illustrated embodiment according to FIGS. 5 to 8 such that the tightening tool 7 or the eccentric clamp is inserted into a recess or opening 13 in the fixation element 5. Since the tightening tool 7 or the eccentric clamp also engages in this case in the recess 12 in the holddown clip 6 it also guides the tightening tool 7 on the holddown clip 6.

The tightening tool 7 according to the variant in FIGS. 5 to 8 is also equipped with at least one stop 14 that prevents overtightening or excessively high clamping forces. This will be explained in greater detail with reference to FIG. 8. In any case, the tightening tool 7 can be aligned in various clamping positions relative to the holddown clip 6 and therefore the wallboards 3 in comparison to the substructure 2.

Figure 8A:
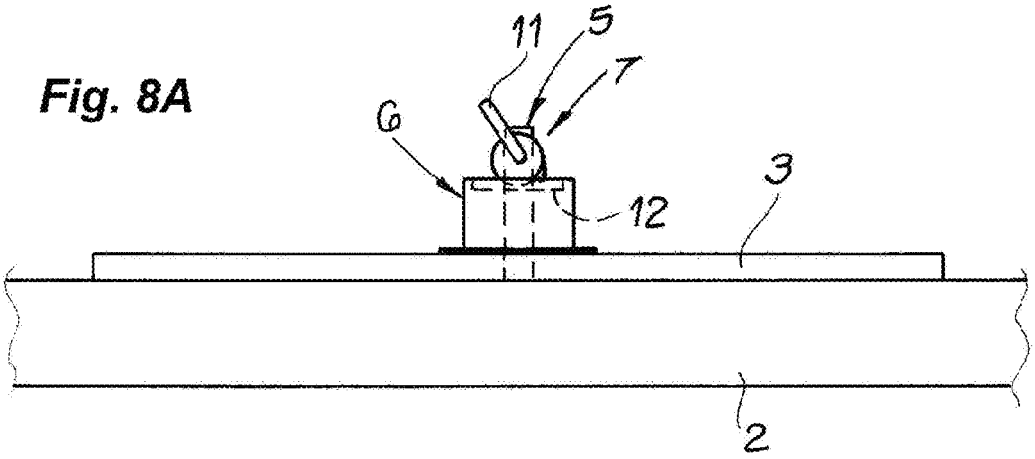
FIGS. 8A, 8B, and 8C are side views illustrating use of the second variant.
Figure 8B:
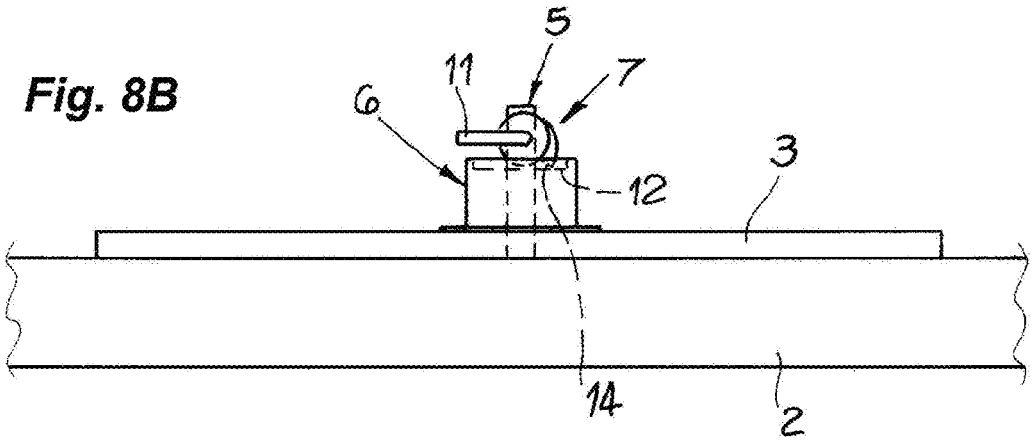
Figure 8C:
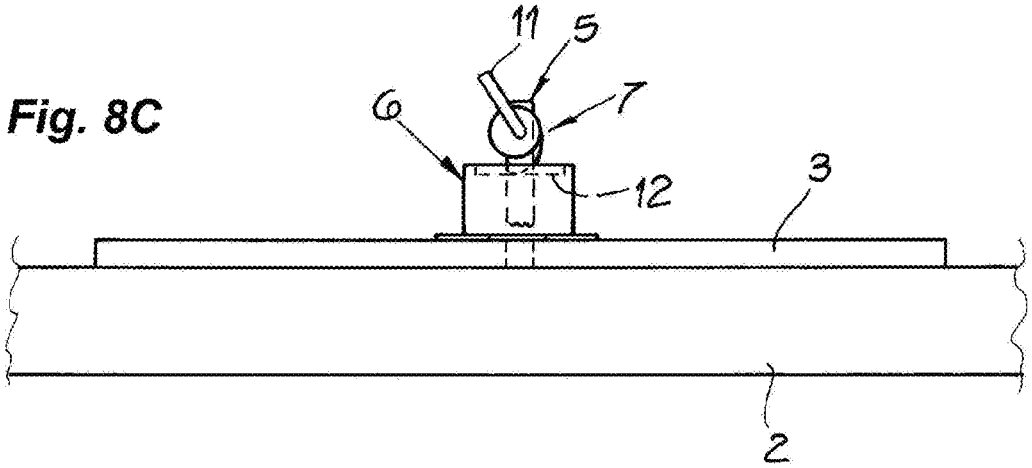

It can be seen on the basis of FIG. 8 that the tightening tool 7 is fixed in various clamping positions on the substructure 2 or the holddown clip 6 is fixed with the aid of the fixation element 5, with the wallboard 3 interposed, relative to the substrate 2. The uppermost clamping position in FIG. 8 actually corresponds to the installation position of the wallboards 3 upon their attachment to the substructure 2. In this installation position, the above-described adhesive 10 has typically already been applied between the wallboard 3 and the substructure 2, so that after the adhesive 10 cures, the holddown clip 6 can be removed as already described.

The middle illustration in FIG. 8 shows the gluing position and the position corresponding thereto of the tightening tool 7 in the defined or desired clamping position, specifically the clamping position that corresponds to the gluing position. In order that this position can be assumed in a defined manner, the above-described stop 14 on the tightening tool 7 ensures that "overtightening" does not occur. This is because the stop 14 presses against the base of the recess 12 of the holddown clip 6 in the gluing position.

The lowermost position in FIG. 8 finally shows a so-called detaching or tear-off position, in which the clamping forces applied with the aid of the operating tool 11 to the tightening tool 7 are sufficiently large that separation of the fastening strap 5 from the stump or foot 5' occurs at the intended breakpoint 9 of the fixation element 5.

Basically, a similar procedure is used in the illustrated embodiment according to FIGS. 5 to 8 as was already described above. This means that first the fixation element or the fastening strap 5 is fastened on the substructure 2, specifically as explained with reference to FIGS. 1 to 4. The holddown clip 6 is subsequently fitted with its slot that can be recognized in FIG. 7, or the slot 8 onto the fixation element or the fastening strap 5. The installation position in the uppermost position according to FIG. 8 then is assumed, and finally the transition into the gluing position in the scope of the middle illustration according to FIG. 8 takes place. In this case, the mutual interlocking teeth 15 or the alternating catch formations 15 again ensure that the holddown clip 6 maintains its clamping position that is achieved with the aid of the tightening tool 7 relative to the fixation element 5. It can be seen that to implement the interlocking teeth 15, corresponding teeth are implemented on the fixation element or the fastening strap 5 above the intended breakpoint 9, which latch with corresponding spring tongues in the above-described slot or the slot 8 of the holddown clip 6.

The invention claimed is:

1. A method of making a drywall comprising the steps of:

applying an adhesive to a frame and or to an inner face of a wallboard, thereafter placing the wallboard on the frame with the inner face engaging the frame via the adhesive, and fixing a fixation element having a predetermined breakpoint to the frame at the edge of the wallboard or in a joint between two adjacent wallboards so as to project outward past an outer face of the wallboard, fitting a holddown clip to a recess of a tightening tool, the fixation element and the holddown clip having complementary catch formations, and thereafter releasably by use of the tightening tool sliding the holddown clip down the fixation element to interengage the formations and latch the holddown clip to the fixation element via the formations, to prevent movement of the holddown clip away from the frame, to press the inner face of the wallboard against the adhesive on the frame, and to clamp the wallboard between the frame and the holddown clip in a defined clamping position, and thereafter, after curing of the adhesive, separating the fixation element together with the holddown clip from the frame while leaving the wallboard adhered to the frame.

2. The method according to claim 1, wherein the fixation element is fixed on a profile beam of the frame.

3. The method according to claim 1, wherein the fixation element is a fastening strap that projects beyond the outer face of the wallboard.

4. The method according to claim 1, wherein the fixation element engages through a slot in the frame or in the holddown clip.

5. The method according to claim 1, wherein the breakpoint is between the outer face of the wallboard and the frame in the installed state of the fixation element.

6. The method according to claim 1, wherein the tightening tool is detachably coupled to the fixation element, the method further comprising the step of:

detaching the tightening tool from the holddown clip after clamping the wallboard.

7. The method according to claim 1, wherein the tightening tool fixes the holddown clip at least in the defined clamping position on the fixation element by means of an integrated tightening mechanism or an attachable operating tool.

8. The method according to claim 1, further comprising the step of:

blocking the tightening tool from exerting excessively high clamping forces by at least one stop.

9. The method according to claim 1, wherein the tightening tool can be aligned in various clamping positions relative to the holddown clip and therefore the wallboard with respect to the frame.

10. The method according to claim 1, further comprising the step of:

filling the joint between adjacent wallboards or the edge area with sealant.

11. A method of making a wall from a frame and a wallboard, the method comprising the steps of:

applying a curable adhesive to an outer face of the frame and securing to the frame a plurality of fixation straps having break points so that the straps project outward from the frame and the breakpoints are spaced from the frame by a distance equal to less than a thickness of the wallboard; thereafter placing an edge of the wallboard on the frame immediately adjacent the fixation straps such that the breakpoints are between an outer face of the wallboard and the frame; thereafter fitting holddown clips one after another to a tightening tool and then by use of the tightening tool to each of the straps and sliding the holddown clips down the respective straps by use of the tool so they engage the wallboard adjacent the edge thereof, assume respective clamping positions, and press the wallboard into the adhesive on the frame, whereby the holddown clips clamp the wallboard against the frame; thereafter securing the holddown clips in the respective clamping positions; thereafter curing the adhesive such that it fixes the wallboard to the frame; and thereafter removing outer portions of the straps outward of the respective breakpoints along with the holddown clips.

12. The method defined in claim 11, wherein the portions of the straps and the holddown clips are removed by applying sufficient tension to the straps that they rupture the straps at the respective breakpoints.

* * * * *